US009756890B2

(12) United States Patent
Moreau et al.

(10) Patent No.: US 9,756,890 B2
(45) Date of Patent: Sep. 12, 2017

(54) TETHER CLIP FOR HARD HATS

(71) Applicant: Ty-Flot, Inc., Manchester, NH (US)

(72) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 50 days.

(21) Appl. No.: 14/552,966

(22) Filed: Nov. 25, 2014

(65) Prior Publication Data

US 2016/0143384 A1 May 26, 2016

(51) Int. Cl.
*A42B 3/08* (2006.01)
*A42B 3/04* (2006.01)
*A44B 13/00* (2006.01)

(52) U.S. Cl.
CPC ..... *A42B 3/08* (2013.01); *A42B 3/04* (2013.01); *A44B 13/00* (2013.01); *A44B 13/0029* (2013.01)

(58) Field of Classification Search
CPC ..... A42B 3/04; A42B 3/0473; A42B 3/08; A42B 3/0403; A42B 3/0406; A42B 3/0413; A42B 7/00; Y10T 24/4016; Y10T 24/4077; A44B 11/12; A44B 11/2526; A44B 11/2549; A44B 13/00; A44B 13/0029
USPC ..... 2/421, 410, 6.2, 6.6, 422, 175.4
See application file for complete search history.

(56) References Cited

U.S. PATENT DOCUMENTS 4,391,000 A * 7/1983 Lonnstedt ..... A42B 3/04 2/209
4,991,236 A 2/1991 Pritchett
5,658,065 A * 8/1997 Jamieson ..... A42B 3/04 2/422
5,675,841 A * 10/1997 Jackson ..... A42B 7/00 2/175.7
6,154,887 A 12/2000 Yagi
8,117,678 B2 * 2/2012 Moreau ..... A42B 3/04 2/410
D683,653 S * 6/2013 Moreau ..... D11/215
D699,100 S * 2/2014 Moreau ..... D8/394
D741,554 S * 10/2015 Moreau ..... D29/122
2010/0012692 A1 * 1/2010 Harris ..... A42B 3/185 224/181
2010/0064405 A1 * 3/2010 McGovern ..... F41H 1/04 2/6.7
2011/0113529 A1 * 5/2011 Milioto ..... A42B 1/24 2/209.13
2013/0180033 A1 * 7/2013 Uemoto ..... A42B 3/30 2/410

* cited by examiner

*Primary Examiner* — Khoa Huynh
*Assistant Examiner* — Griffin Hall

(57) ABSTRACT

A slot member for a hard hat having a universal accessory slot includes a slot member body having a proximal body end portion and a distal body end portion, a front face, and a rear face. The slot member body includes a resilient tab protruding away from the front face of the slot member body and a lip extending away from the rear face of the slot member body and defining a catch surface facing towards the distal body end portion. The slot member body is plate-like and sized to be received through the universal accessory slot of the hard hat with the lip overlapping the slot rim. A latch plate adjoins and extends distally from the distal body end portion of the slot member body, where the latch plate has a latch opening defining an attachment handle.

17 Claims, 9 Drawing Sheets

TETHER CLIP FOR HARD HATS

BACKGROUND OF THE INVENTION

1. Field of the Invention

The present invention relates generally to accessories for hard hats and drop-prevention devices. Particularly, the present invention relates to a tether clip for hard hats.

2. Description of the Prior Art

Hard hats are a mandatory safety item used in or around electrical power plants, chemical plants, construction sites, warehouses, and other industrial sites. Their use is mandated through safety programs and addresses overhead hazards present in these industries. Hard hats are intended to be a type of safety equipment that will protect the wearer from overhead hazards as well as from bumping one's head in areas of low clearance. In some cases, the hard hat is considered a hazard itself. For instance, in most industrial work sites where overhead work is being performed, workers are typically wearing a hard hat. If a worker leans over or bumps his/her head, the hard hat may fall off the wearer's head. The falling hard hat can become a drop hazard to personnel or vital plant equipment below.

In other cases, such as at nuclear power plants, workers often will work from a bridge crane that straddles a reactor vessel filled with water. If the hard hat falls off the worker, it may land in the pool of water. If the hard hat cannot be retrieved before it sinks, then the retrieval process may be time consuming and very costly. Typically, a nuclear power plant will lose approximately $100,000 per hour of down time during a refueling or maintenance outage. Depending on where the hat comes to rest, it could take several hours to retrieve the hard hat and consequently delay the plant from coming back online.

A chin strap used with a hard hat is one method to keep the hard hat on a wearer's head. However this method can be uncomfortable and cumbersome. Also, hard hat chin straps used in contaminated environments may become contaminated themselves since the strap is usually made of fabric that absorbs or retains liquids and particle contaminants. For this reason, items in direct contact with exposed skin require frequent cleaning prior to donning. However, hard hats are not typically laundered, even those with chin straps.

U.S. Pat. No. 701,639 (1902, Stamm) discloses a hat guard device that prevents a straw hat from blowing away. The device includes a cord, a flat tapering pin attached to one end of the cord, and a clamping device secured at the opposite end of the cord provided with two openings or eyes and a V-shaped clamping hook. The tapering pin is adapted to be pierced through the body of the hat near the brim. The cord passes through the eyes and is knotted to secure it. When the hat is not in use, the cord is tightly wrapped around the body of the hat and the clamping hook is hooked on the cord and bites into the cord to firmly retain the clamping device in position. When the hat is in use, the V-shaped clamping hook is released from the cord and passed through a lapel button hole of a coat and fastened as desired.

U.S. Pat. No. 4,991,236 (1991, Pritchett) discloses a hat retaining device with a cord that attaches at one end to a hat with an alligator clip or suspenders clip. The other end of the cord defines a loop sized to be worn around the wearer's neck.

U.S. Pat. No. 6,154,887 (2000, Yagi) discloses a hat and retaining device to prevent the hat from blowing away in windy conditions. The retaining device has a cloth string with a first end fixed to the top button of a crown of a baseball cap. In one embodiment, the first end of the cloth string is passed through a grommet in the hat and then knotted to prevent its release. In another embodiment, the first end of the cloth string is secured by sewing to cloth tape attached along seams of the crown.

U.S. Pat. No. 8,111,678 (2012, Moreau et al.) discloses a hard hat lanyard in combination with a hard hat that includes a strap with a first end and a second end. The first end is secured to a fastening mechanism that wraps around a hard hat inner brim. Alternately, a button snap is secured to the first end of the strap and is adapted to fastening to a mating snap on the hard hat shell. A fastening mechanism, such as a clip, is fastened to the second end is adapted to be secured to an article of clothing.

SUMMARY OF THE INVENTION

The hat retention devices of the prior art have deficiencies that have not been fully addressed for hard hats. The Stamm hat guard is acceptable for straw hats and other hats made of a flexible material. However, one cannot insert a hook into the brim of a hard hat because the hard hat material is inflexible. Also, hard hats typically have a domed shell that extends over the wearer's head, rather than a cylindrical body, so a cord wrapped around the outside of the shell would tend to slip off. Further, the weight of a hard hat would pull the clamping device through a lapel button hole. Furthermore, industrial workers are unlikely to wear jackets having lapel button holes.

The Yagi hat retention device is unsuitable for use with a hard hat because it would require modifying standard safety equipment made to a particular standard. This is because the Yagi device is intended to be stitched into cloth strips along seams of the hat or passed through an eyelet in cloth hats. Since a hard hat lacks these features, the Yagi device is not usable with a hard hat.

The Pritchett retaining cord would be unsuitable for use with a hard hat because of the danger of attaching a loop around the wearer's neck when working in an industrial environment. Also, an alligator clip or suspenders clip does not firmly grasp the plastic brim of a hard hat since the hard hat is not pliable.

The Moreau et al. hard hat tether relies on a cord that loops around the suspension system of the hard hat. A cord that attaches to the hard hat with a snap button requires that the hat include a mating snap that provides a strong coupling to prevent unintentional release of the snap and snap button.

In addition to the deficiencies mentioned above, none of the prior art hat retention devices provides a storage location for a hard hat tether when the second end is not attached to the wearer. For some tethers, the first end of the hat-end of the tether is permanently or semi-permanently secured to the hard hat, such as by being looped through a chin-strap opening of the hard hat. The second end of the tether may have a clip member that can be secured to clothing to tether the hard hat to the wearer. However, when storing the hard hat and when using the hard hat in situations where the tether is not needed, the wearer often clamps the clip member to the brim of the hard hat. Due to the brim's thickness and hardness, when the clip member is made of metal, clamping the clip member to the brim bends the clip member and it no longer securely clamps to clothing as intended. When the clip member is made of plastic, clamping the clip member to the brim stretches or deforms the clip member and weakens its grip when clamping it to clothing. In either case, the user needs a different location to stow the clip member to prevent degrading or ruining the ability of the clip member to attach securely to clothing or the like.

Therefore, what is needed is a device that provides a storage option for the hard hat tether when the tether is not used to tether the hat to the wearer's person.

It is an object of the present invention to provide a device that enables the wearer of a hard hat to stow the unused end of hard hat tether out of the way when the tether is not used to tether the hard hat to the wearer.

The present invention achieves this and other objectives by providing a slot member for use with a hard hat. In one embodiment, the slot member includes a slot member body having a proximal body end portion and a distal body end portion, a front face, and a rear face. The slot member body includes a resilient tab protruding in a first direction away from the front face of the slot member body and a lip extending from the proximal body end portion in a second direction away from the rear face of the slot member body and defining a catch surface facing towards the distal body end portion, where the second direction is generally opposite of the first direction. The slot member body is plate-like and sized to be received through the universal accessory slot of the hard hat with the resilient tab abutting a first slot wall and the lip overlapping the slot rim. A latch plate adjoins and extends distally from the distal body end portion of the slot member body. The latch plate has a latch opening extending therethrough and defining an attachment handle.

In another embodiment, the latch plate and the slot member body define an angle therebetween from about 120° to 180°.

In another embodiment, the resilient tab includes a tab body connected to the slot member body and extending transversely from the plate-like body to a distal tab portion, wherein the resilient tab defines a gap between the distal tab portion and the front face of the slot member body thereby permitting the resilient tab to flex towards the front face.

In another embodiment, the slot member body has a substantially U-shaped opening defining a tab body connected to the slot member body at a proximal tab end and extending to a distal tab end portion. The tab body includes a tab protrusion connected to the distal tab end portion and extending in the first direction beyond the front face.

In some embodiments, when the slot member body is installed in the universal accessory slot, the resilient tab abuts the first slot wall, thereby biasing the slot member body towards the second slot wall and biasing the lip to overlap the slot rim along the universal accessory slot.

In another embodiment, the slot member body has an arcuate shape across a width of the slot member body.

In another embodiment, the slot member includes a clip member defining a strap through-opening and having a locking mechanism adapted to secure the clip member to the latch plate. In one embodiment, the connector mechanism includes an open-ended slot sized to receive the attachment handle. A clip lever pivotably attached to the clip body is operable between a first position and a second position. The clip lever has a protrusion extending from the lever portion, where the protrusion substantially closes the open-ended slot when the clip lever is in the first position and opens the open-ended slot when the clip lever is in the second position.

In another embodiment, the slot member is part of a combination with the hard hat. In some embodiments, the combination includes a hard hat tether. In other embodiments, the combination includes a clip member adapted to be attached to the latch plate of the slot member.

In another embodiment, the slot member includes a connector loop extending transversely from the latch plate and defining a connector loop opening. The connector loop has a U-shape in one embodiment. In some embodiments, the connector loop is used, for example, to attach one end of a hard hat lanyard to the slot member where the other end of the hard hat lanyard is secured to a clip member. In some embodiments, the connector loop is removably attached to the slot member; in other embodiments, the connector loop and the slot member comprise a unitary, monolithic member made as a single item of the same material.

In another aspect of the invention, a method of storing a hard hat tether attached to a hard hat, the method includes the steps of providing a hard hat having at least one universal accessory slot with at least one universal accessory slot having an accessory slot opening between a first slot wall and a second slot wall opposing and spaced apart from the first slot wall, and a slot rim extending along the universal accessory slot transverse to the accessory slot opening; providing a slot member that includes a slot member body and a latch plate adjoining and extending distally from the slot member body, such as embodiments discussed above; providing a clip member defining a strap opening and having a locking mechanism adapted to secure the clip member to the latch plate; providing a hard hat tether having a first tether end and a second tether end; securing the first tether end of the hard hat tether to the clip member; installing the slot member into the at least one universal accessory slot by inserting the slot member body into the accessory slot opening with the protrusion extending therethrough with the catch surface overlapping the slot rim; and attaching the clip member to the latch plate of the slot member.

In another embodiment, step of securing the second tether end to the hard hat includes extending the second tether end through a second universal accessory slot of the hard hat and securing the second tether end to the hard hat lanyard a predefined distance from the second tether end.

In another embodiment, the step of providing a slot member includes selecting the slot member to define an angle from about 120° to 180° between the latch plate and the slot member body.

These and other features, aspects, and advantages of the present invention will become better understood with regard to the following description, claims, and accompanying drawings.

DETAILED DESCRIPTION OF THE INVENTION

Figure 1:
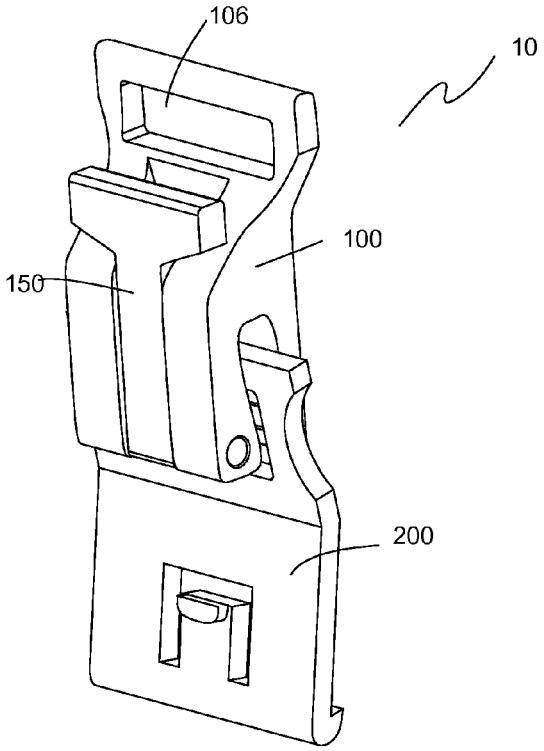
FIG. 1 is a perspective view of a tether clip system of the present invention including a clip member and a slot member, where the locking mechanism of the clip member is in a first position.
Figure 2:
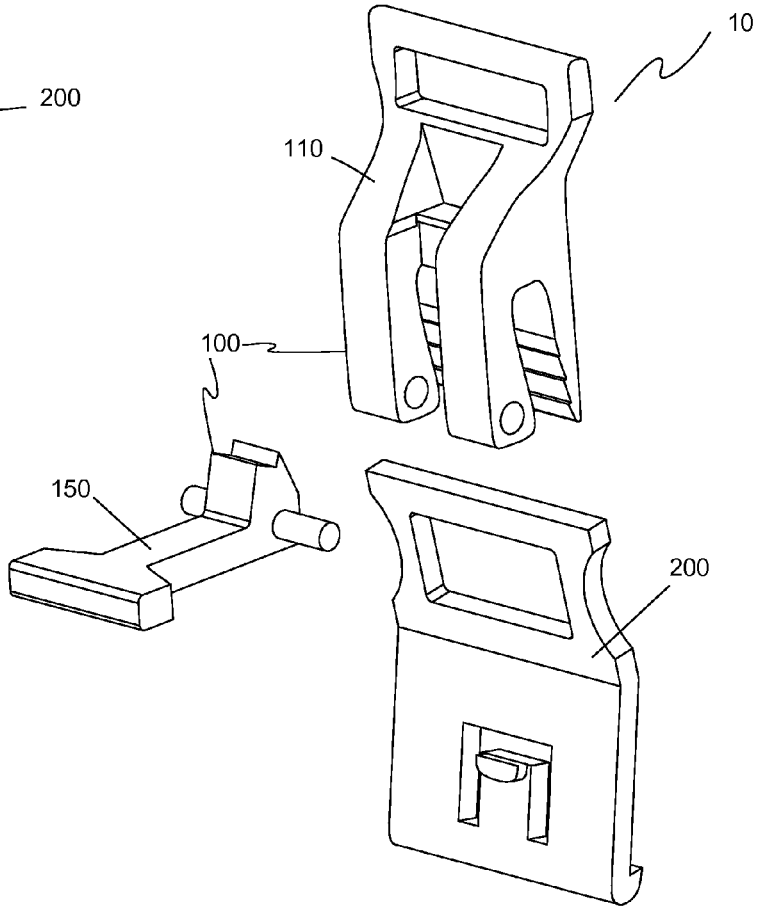
FIG. 2 is a perspective view of the tether clip system of FIG. 1 showing the clip member exploded with the locking mechanism in a second position and showing the clip member separated from the slot member.

Embodiments of the present invention are illustrated in FIGS. 1-11. FIG. 1 is a perspective illustration of one embodiment of a tether clip system 10 that includes a clip member 100 that is releasably attachable to a slot member 200. In FIG. 1, clip member 100 is releasably attached to slot member 200. Tether clip system 10 is shown in a perspective view in FIG. 2 with clip member 100 separated from slot member 200 and with components of clip member 100 shown disassembled. Clip member 100 includes a clip member body 110 and a locking mechanism 150 operably connected to clip member body 110. Locking mechanism 150 is operable between a first (closed) position (shown in FIG. 1) and a second (open) position (shown in FIGS. 2, 7B, & 10) and adapted to secure clip member 100 to slot member 200. Components of tether clip system 10 are discussed in more detail below.

Figure 3A:
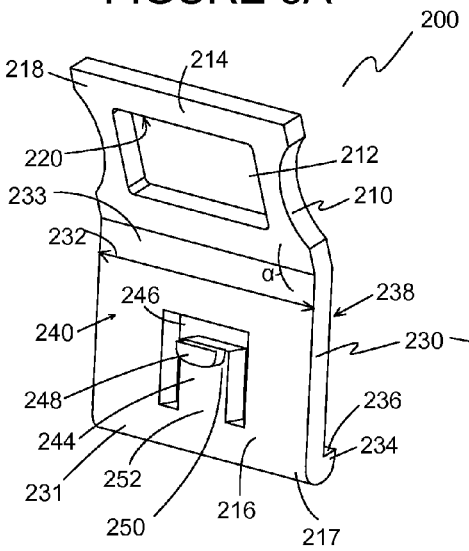
FIG. 3A is a perspective view of the slot member of FIG. 1.
Figure 3B:
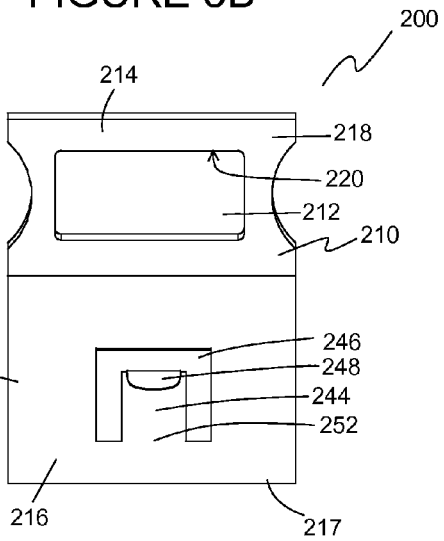
FIG. 3B is a front elevational view of the slot member of FIG. 3A.
Figure 3C:
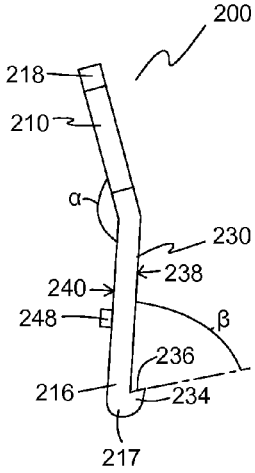
FIG. 3C is a side elevational view of the slot member of FIG. 3A.
Figure 3D:
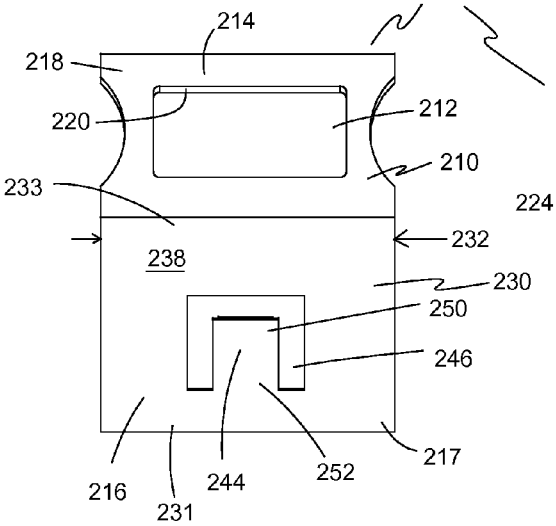
FIG. 3D is a rear elevational view of the slot member of FIG. 3A.

Turning now to FIGS. 3A-3D, one embodiment of slot member 200 is shown in a perspective view (FIG. 3A), a front elevational view (FIG. 3B), a side elevational view (FIG. 3C), and a rear elevational view (FIG. 3D). Slot member 200 is a substantially flat, plate-like structure that extends from a slot member proximal portion 216 to a slot member distal portion 218. Slot member 200 includes a latch plate 210 and a slot member body 230.

Latch plate 210 has a latch opening 212 that defines an attachment handle 214. In one embodiment, attachment handle 214 is along slot member distal portion 218. In one embodiment, latch plate 210 is substantially rectangular. Other shapes of latch plate 210 and positions of attachment handle 214 are acceptable provided that clip member 100 or other connector can attach to latch plate 210. Latch opening 212 is sized and positioned so that clip member 100 or other connector can attach to latch plate 210, for example, by extending over attachment handle 214 and into or through latch opening 212 so as to be positioned to engage distal inner surface 220 of attachment handle 214. Clip member 100 is discussed in more detail below.

Slot member 200 has a slot member body 230 that extends from a proximal body end portion 231 to a distal body end portion 233. In some embodiments, proximal body end portion 231 is the same as slot member proximal portion 216. Slot member body 230 has a rear face 238 and a front face 240. Slot member body 230 is contiguous with latch plate 210, where latch plate 210 connects to and extends distally from distal body end portion 233 of slot member body 230. Slot member body 230 is sized to fit into a universal accessory slot 310 of a hardhat 300 (shown in FIGS. 8-10). In some embodiments, slot member body 230 has an arcuate shape across its width 232 that is consistent with the curvature of a hard hat brim 302.

Optionally, front face 240 of slot member body 230 defines an angle $\alpha$ with latch plate 210 from about 120° to 180°. In one embodiment, angle $\alpha$ is about 160° to 175°, such as about 170°. When slot member body 230 is inserted downwardly into universal accessory slot 310 of a hardhat 300 with front face 240 facing away from hard hat 300, angle $\alpha$ causes attachment handle 214 to be spaced apart from a shell 301 of hard hat 300 for easier access when attaching clip member 100 to slot member 200. It is contemplated that slot member 200 optionally may be inserted upwardly through universal accessory slot 310.

Slot member proximal portion 216 has a lip 234 that extends in a first direction transversely away from rear face 238 of slot member body 230. Lip 234 defines one or more catch surface 236 that faces generally towards slot member distal portion 218. In some embodiments, slot member body 230 has a rounded proximal end 217 that is continuous with and includes lip 234. In one embodiment, catch surface 236 defines an angle $\beta$ of 90° or less with rear face 238 of slot member body 230. As such, catch surface 236 tends to better engage another surface without slipping, such as a slot rim 304 of brim 302 along universal accessory slot 310 of hard hat 300 (shown in FIG. 9). In one embodiment, angle $\beta$ is between about eighty and ninety degrees.

Slot member body 230 has a flexibly resilient tab 244 that protrudes away from a front face 240 of slot member body in a direction opposite of lip 234. In one embodiment, slot member body 230 has a substantially U-shaped tab opening 246 that contains tab 244 with proximal tab end 252 connected to slot member body 230. In such an embodiment, tab 244 may be substantially coplanar with slot member body 230, in which case tab 244 includes a tab protrusion 248 that extends a predefined distance beyond front face 240. Tab protrusion 248 may be formed on, affixed to, or otherwise connected to a distal tab end portion 250. In other embodiments where tab 244 is defined by U-shaped tab opening, tab 244 is formed or caused to extend beyond front face 240 of slot member body 230. One method of causing tab 244 to extend beyond front face 240 is to heat tab 244 to a softened or flexible state, bend tab 244 to the desired position, then quench tab 244, where tab 244 thereafter maintains the desired position. In yet other embodiments, tab 244 is a flap or piece of material that is attached to, formed on, or connected to slot member body 230 and extending from front face 240. When slot member 200 is installed in universal accessory slot 310 of hard hat 300 (shown in FIGS. 8-10), tab 244 extends to engage a first slot wall 314, thereby biasing slot member body 230 towards a second slot wall 316 that is opposite and spaced apart from first slot wall 314. As a result, catch surface 236 is also biased to overlap and/or engage slot rim 304, thereby preventing accidental removal of slot member body 230 from hard hat 300.

Figure 3E:
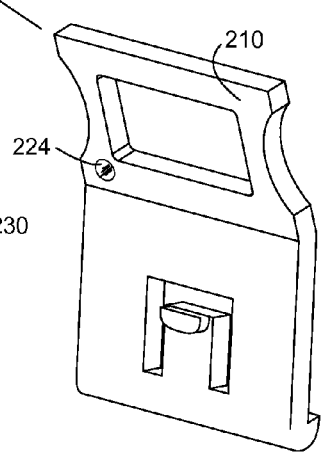
FIG. 3E is a perspective view of another embodiment of a slot member of the present invention shown with a tether opening.

Turning now to FIG. 3E, a perspective illustration shows another embodiment of slot member 200 that includes an optional tether opening 224. Tether opening 224 is useful for securing a first tether end 332 of hard hat tether 330 to slot member 200. In one embodiment, tether opening 224 is a circular bore through latch plate 210 or other portion of slot member 200 and is sized to accommodate a cable, coil, string, cord, or the like. For example, hard hat tether 330 is a polyurethane coil, where first tether end 332 is inserted through circular tether opening 224. Tether 330 is secured in tether opening 224 by attaching a crimp or fitting to first tether end 332, thereby preventing first tether end 332 from passing back through tether opening 224. In another example, hard hat tether 330 is a leather cord, where a knot tied at first tether end 332 maintains it in tether opening 224. In other embodiments, tether opening 224 is a slot or has another shape consistent with the type of hard hat tether 330 being used.

Figure 4A:
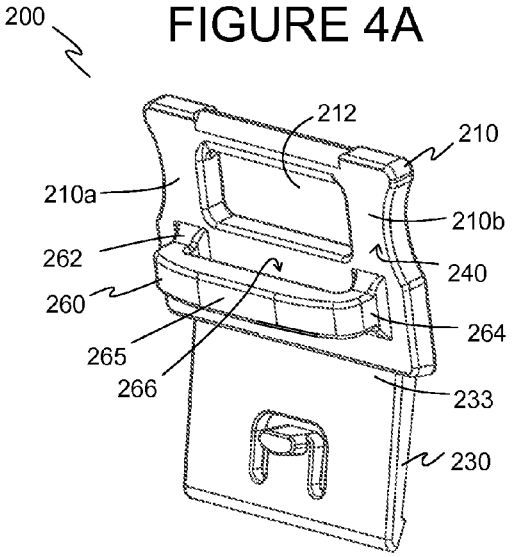
FIG. 4A is a front perspective view of another embodiment of a slot member shown with a connector loop extending from the latch plate.
Figure 4B:
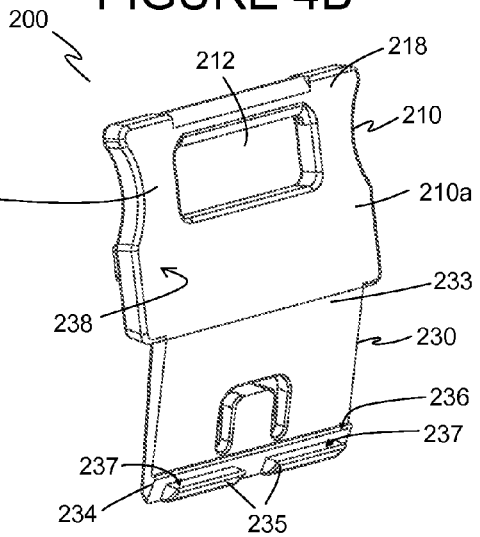
FIG. 4B is a rear perspective view of the slot member of FIG. 4A showing a lip that includes lip protrusions.
Figure 4C:
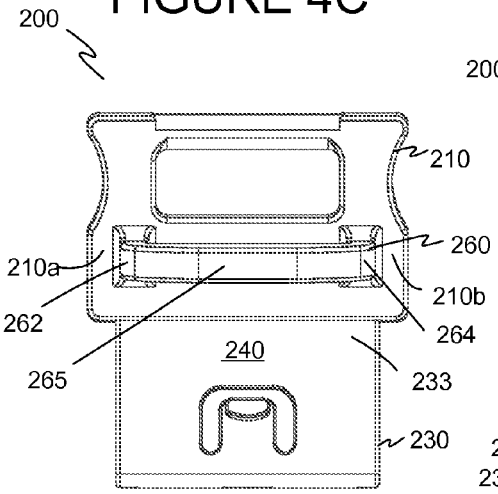
FIG. 4C is a front elevational view of the slot member of FIG. 4A.
Figure 4D:
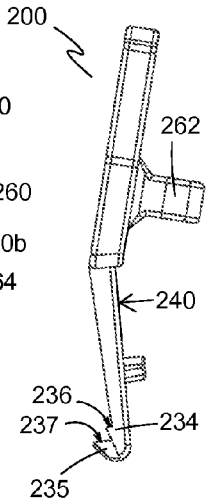
FIG. 4D is a side elevational view of the slot member of FIG. 4A.
Figure 4E:
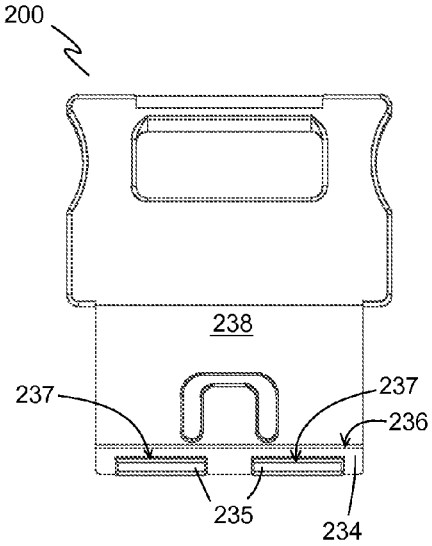
FIG. 4E is a rear elevational view of the slot member of FIG. 4A.

Turning now to FIGS. 4A-4E, another embodiment of a slot member 200 is shown in a front perspective view (FIG. 4A), a rear perspective view (FIG. 4B), a front elevational view (FIG. 4C), a side elevational view (FIG. 4D), and a rear elevational view (FIG. 4E). In this embodiment, slot member 200 includes a connector loop 260 that is integrally connected to and extending transversely from front face 240. In one embodiment, connector loop 260, latch plate 210, and slot member body 230 define a unitary, monolithic member. Connector loop 260 substantially has a U-shape with a first loop arm 262 connected to a first side portion 210*a* of latch plate 210 and a second loop arm 264 connected to a second side portion 210*b* of latch plate 210 in a spaced apart relation. A connector loop body portion 265 extends between and connects first loop arm 262 and second loop arm 264.

In one embodiment, first loop arm 262 and second loop arm 264 are each connected to latch plate 210 in a region between latch opening 212 and distal body end portion 233 of slot member body 230. Together with latch plate 210 (or slot member body 230, depending on location), U-shaped connector loop 260 defines a closed loop with a connector loop opening 266 that is sized to receive a portion of hard hat tether 330 therethrough. It is contemplated that connector loop 260 could also attach to rear face 238 of latch plate 210, to distal end portion 233 of slot member body 230, or other locations on slot member 200 provided that connector loop 260 does not interfere with insertion of slot member 200 into universal accessory slot 310 or with attachment of clip member 100 to slot member 200.

In use, this embodiment of connector loop 260 is useful to connect hard hat tether 330 to slot member 200, where a portion of hard hat tether 330 (e.g., second tether end 332) is looped through connector loop opening 266. With hard hat tether 330 secured connector loop 260, latch plate 210 remains available for attaching clip member 200. Thus, slot member functions to provide latch plate 210 for stowing clip member 100 when it is not clipped to the user's clothing or other object as well as securing hard hat tether 330 to hard hat 300. As a result, only one universal accessory slot 310 is occupied with slot member and a hard hat's second universal accessory slot 310 is available for use with other attachments.

As shown in FIGS. 4B, 4D, and 4E, one embodiment of lip 234 includes one or more lip protrusions 235 extending from lip 234 in a direction away from rear face 238. Each lip protrusion 235 has a lip protrusion catch surface 237 that faces generally towards slot member distal portion 218. Each lip protrusion catch surface 237 may or may not be continuous and coplanar with catch surface 236.

Figure 5A:
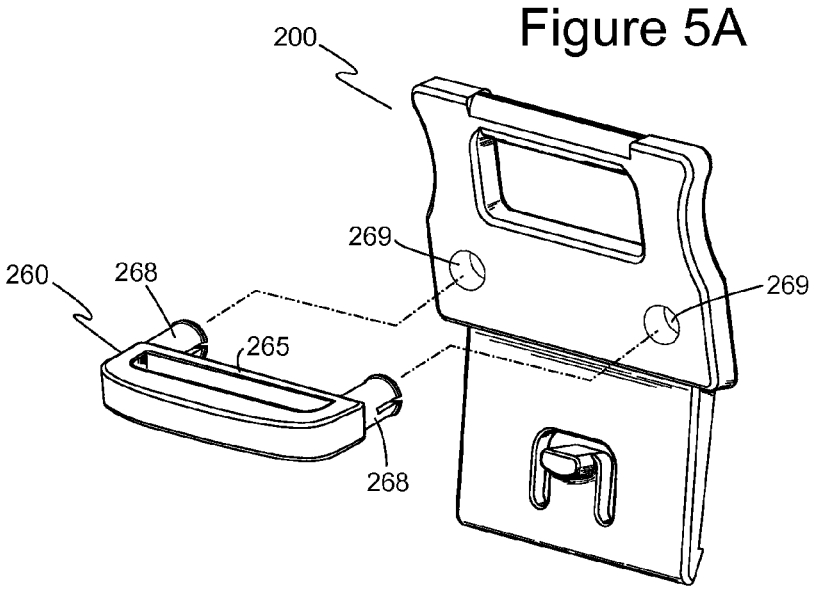
FIG. 5A is perspective view of another embodiment of a slot member of the present invention shown with a removably attachable connector loop with connector posts.
Figure 5B:
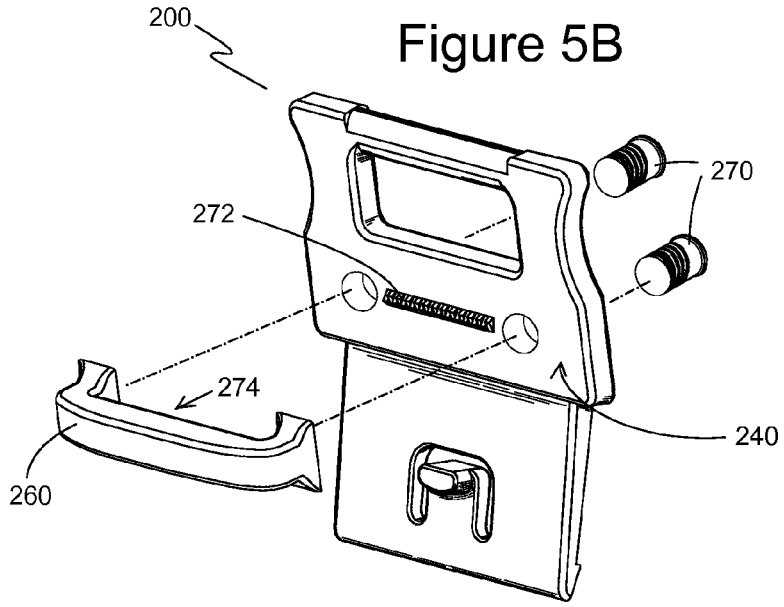
FIG. 5B is a perspective of another embodiment of a slot member of the present invention shown with a removably attachable connector loop with fasteners.

Turning now to FIGS. 5A-5B, perspective illustrations show additional embodiments of slot member 200. In these embodiments, connector loop 260 is removably attachable to slot member 200. As shown in FIG. 5A, for example, connector loop 260 itself is a closed loop that includes at least one connector post 268 extending from connector loop body portion 265. Connector post(s) 268 may be a split cylindrical shaft or other type of snap-fit post or protrusion that can be received through post openings 269 and removably secure connector loop 260 to slot member 200. In other embodiments, connector post(s) 268 are a tab, tooth, or other structure that locks with a corresponding slot, opening, catch, or the like on slot member 200. Of course, connector post(s) 268 may extend from slot member 200 and engage connector loop 260. In other embodiments, connector post (s) 268 is (are) threaded for use with a nut on opposite side of connector opening 269 or with threaded post opening 269. In yet other embodiments as shown for example in FIG. 5B, a fastener 270 (e.g., a machine screw) extends through each connector opening 269 to engage connector loop 260 and removably secure it to slot member 200. Other removable attachment structures are acceptable, such as a tongue on connector loop 260 and a mating groove on slot member 200, and other releasable locking engagement between connector loop 260 and slot member 200.

Optionally, a plurality of teeth 272 extend from front face 240 and/or from an inside surface 274 of connector loop 260. Teeth 272 may be protrusions that are pointed, rounded, or blunt. Teeth 272 may be closely positioned adjacent one another of spread apart as appropriate for the intended use. Teeth 272 are useful, for example, when hard hat tether 330 is made of a length of webbing or the like. Teeth 272 engage and grip hard hat tether that extends through connector loop opening 266 between connector loop 260 and slot member 200, where connector loop 260 may be snugly tightened against hard hat tether 330 to press it into teeth 272 to prevent it from slipping.

Figure 6A:
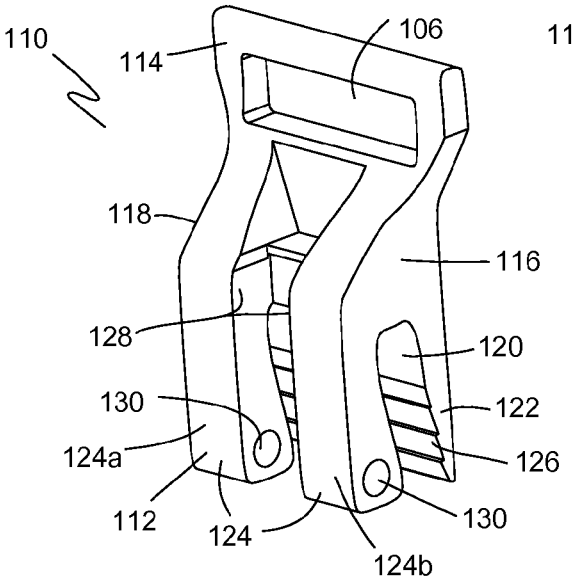
FIG. 6A is a perspective view of one embodiment of a clip body of the clip member of FIG. 1.
Figure 6B:
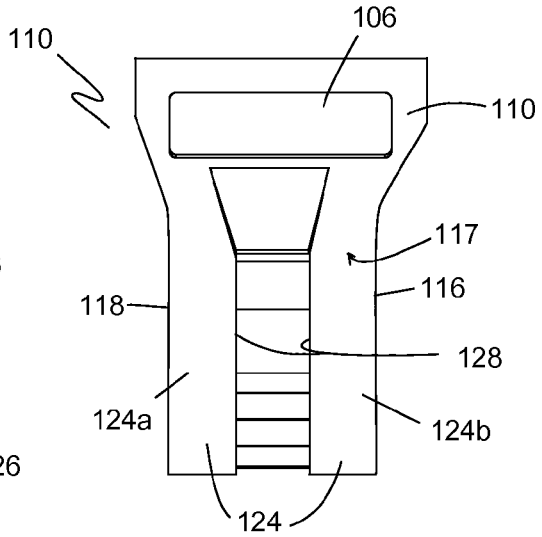
FIG. 6B is a front elevational view of the clip body of FIG. 4A.
Figure 6C:
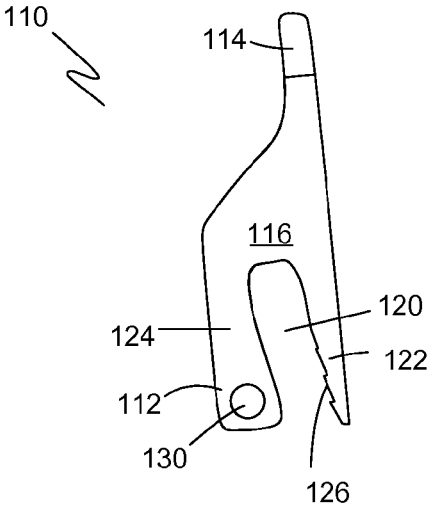
FIG. 6C is a side elevational view of the clip body of FIG. 4A.
Figure 6D:
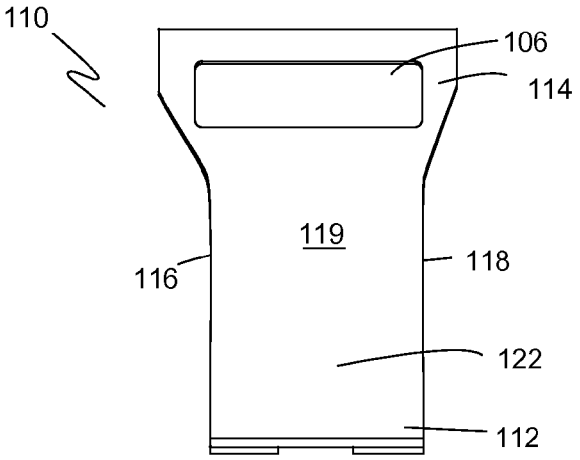
FIG. 6D is a rear elevational view of the clip body of FIG. 4A.

Turning now to FIGS. 6A-6D, one embodiment of a clip member body 110 of clip member 100 is shown in a perspective view (FIG. 6A), a front elevational view (FIG. 6B), a side elevational view (FIG. 6C), and a rear elevational view (FIG. 6D). Clip member body 110 extends between a proximal clip body portion 112 and a distal clip body portion 114. Clip member body 110 extends laterally from a first body side 116 to a second body side 118 and between front body surface 117 and rear body surface 119. Clip member body 110 defines a strap opening 106 through distal clip body portion 112. Strap opening 106 is sized for a strap, cord, coil, cable, connector, or other lanyard tether component. In one embodiment, strap opening 106 is a slot sized for a flat, flexible strap made of webbing, cloth, leather, stretchable material, or the like. Strap opening 106 may also be round or have some other shape suitable for a coupling connector, chain, cord, rope, etc. For example, strap opening 106 is a circular bore through which one end of a polyurethane coil is inserted. To secure the coil to clip member 100, a crimp is secured to the end of the polyurethane coil to prevent it from passing back through strap opening 106.

An open-ended slot 120 extends into clip member body 110 through proximal clip body portion 112 defining a rear jaw 122 and a front jaw 124 that is spaced apart from and substantially parallel to rear jaw 122. Open-ended slot 120 is sized to receive attachment handle 214 of slot member. In one embodiment, open-ended slot 120 separates rear jaw 122 and front jaw 124 by about five millimeters, where attachment handle 214 has a thickness of about three millimeters. In one embodiment, open-ended slot 120 also extends laterally through one or both of first body side 116 and second body side 118 to facilitate attachment to an item that exceeds the width of clip member 110, such as clothing.

Rear jaw 122 optionally includes one or more gripping member 126, such as a ridge, tooth, protrusion, recess, groove, or other structure that facilitates clip member 100 gripping a pliable item, such as clothing or a cloth strap. In one embodiment, front jaw 124 includes a first front jaw portion 124*a* and a second front jaw portion 124*b* on opposite sides of a lever slot 128 that extends distally from proximal clip body portion 112 and through front jaw 124 to open-ended slot 120. In one embodiment, first and/or second front jaw portions 124*a*, 124*b* define a shaft bore 130 for pivotable connection of locking mechanism 150.

Figure 7A:
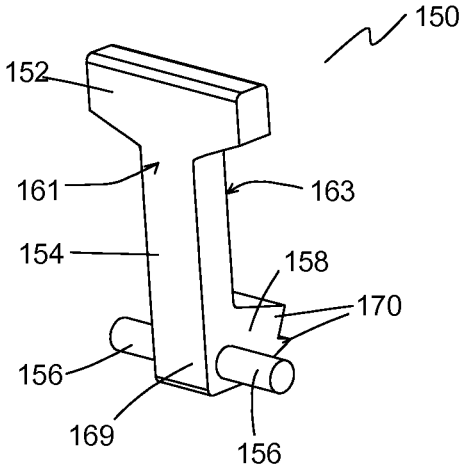
FIG. 7A is a perspective view of locking mechanism of the clip member as shown in FIG. 1.
Figure 7B:
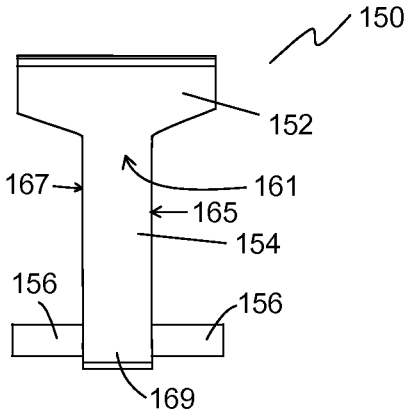
FIG. 7B is a front elevational view of the locking mechanism of FIG. 5A.
Figure 7C:
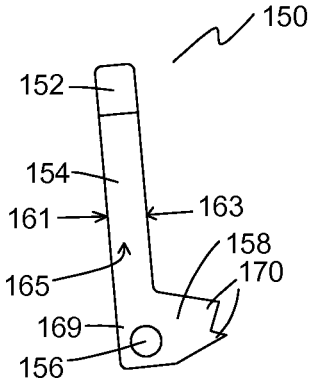
FIG. 7C is a side elevational view of the locking mechanism of FIG. 5A.
Figure 7D:
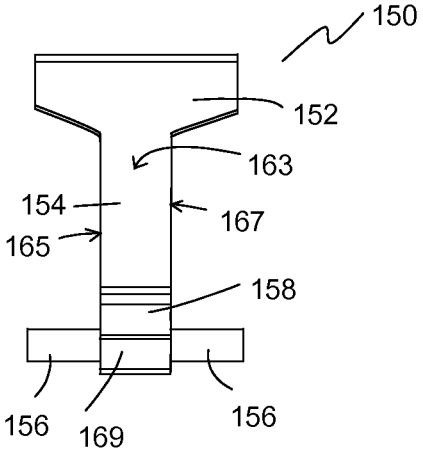
FIG. 7D is a rear elevational view of the locking mechanism of FIG. 5A.

Turning now to FIGS. 7A-7D, one embodiment of a locking mechanism 150 of clip member 100 is shown in a perspective view (FIG. 7A), a front elevational view (FIG. 7B), a side elevational view (FIG. 7C), and a rear elevational view (FIG. 7D). Locking mechanism 150 has a front surface 161, rear surface 163, first side surface 165, and second side surface 167. As shown here, locking mechanism 150 includes an optional handle portion 152, a lever portion 154, a shaft 156, and a protrusion 158. Lever portion 154 connects to and extends proximally from handle portion 152. In one embodiment, lever portion 154 and handle portion 152 define a T-shape.

One or more shafts 156 extend laterally from proximal lever end portion 160. Shaft(s) 156 is (are) sized and configured to be received in shaft bores 130 of clip member body 120 to allow locking mechanism 150 to pivot about shaft(s) 156 between a first position and a second position (shown in FIGS. 1 & 2, respectively). To facilitate assembly with clip member body 120, one or more of shafts 156 is optionally spring biased, similar to a spring pin used for a watch band. In other embodiments, first and second front jaw portions 124*a*, 124*b* are temporarily spread apart for insertion of shafts 156. In yet other embodiments, front jaw 124 or first and second front jaw portions 124*a*, 124*b* include a slot (not shown) or other opening through which shafts 156 are pressed, such as with a snap-fit.

At a proximal locking mechanism end portion 169, protrusion 158 extends transversely and in a rearward direction away from rear surface 163. Optionally, protrusion 158 includes one or more complementary gripping members 170, such as a tooth, slot, ridge, protrusion, recess, or other feature that complements gripping member(s) 126 on rear jaw 124 of clip member body 110. Complementary gripping member(s) 170 further facilitate clip member 100 in attaching to a pliable item, such as an article of clothing or the like.

Figure 8A:
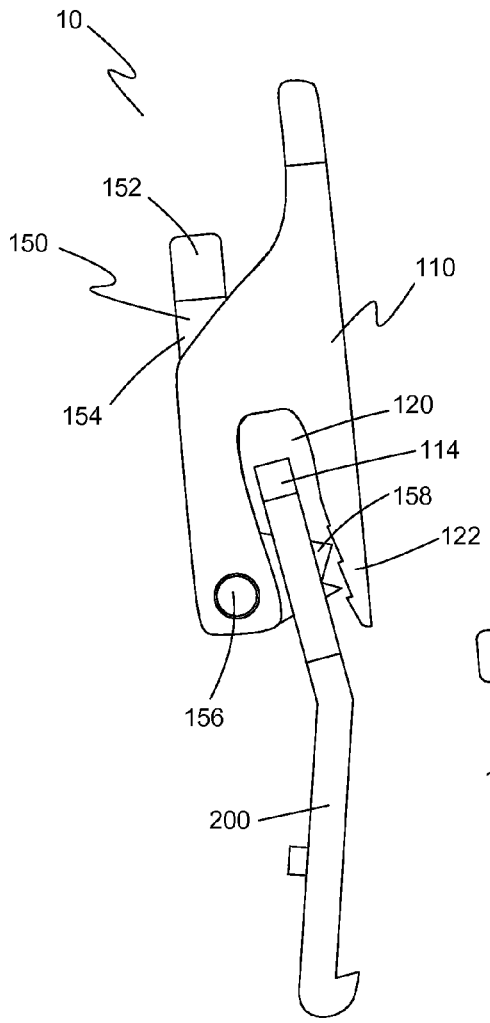
FIG. 8A is a side elevational view of the clip member of FIG. 1 showing the clip member attached to the slot member and the locking mechanism in the first position.
Figure 8B:
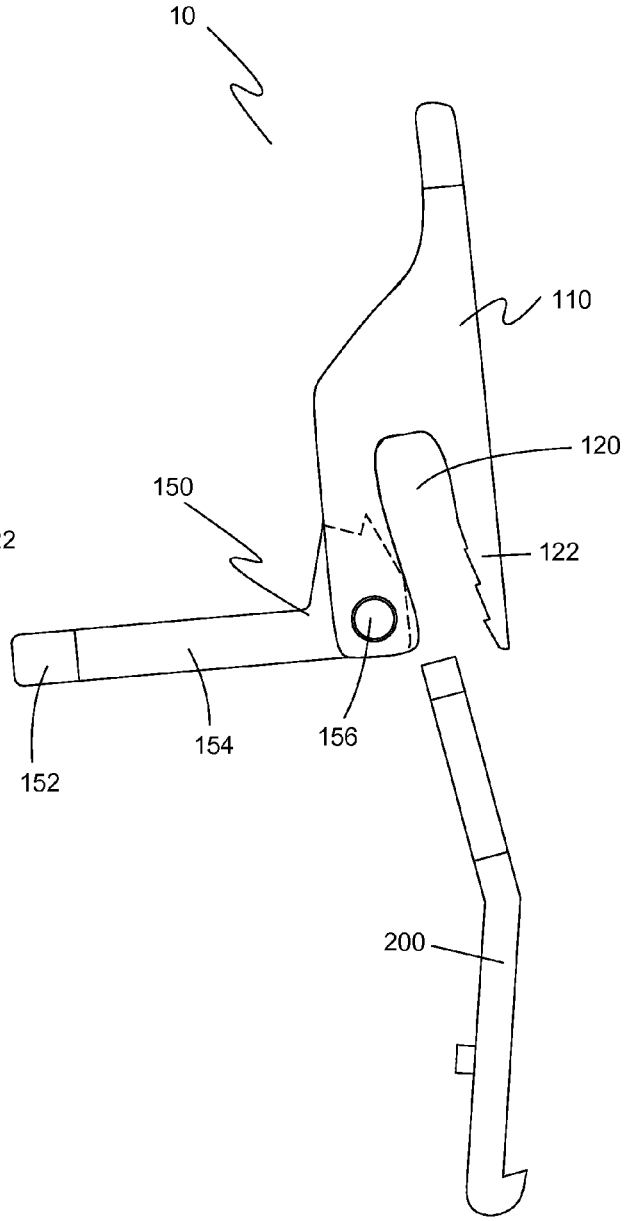
FIG. 8B is a side elevational view of the clip member of FIG. 1 showing the clip member separated from the slot member and with the locking mechanism in the second position.

Turning now to FIGS. 8A and 8B, tether clip system 10 is shown is a side view with locking mechanism 150 shown in a first position and in a second position, respectively. In FIG. 8A, locking mechanism 150 is in the first position where it is pivoted about shaft 156 to substantially abut and align with clip member body 110. Lever portion 152 occupies lever slot 128 (shown in FIGS. 6A & 6B) and handle portion abuts clip member body 110. In the first position, protrusion 158 extends through open-ended slot 120 towards rear jaw 122. When clip member 100 is attached to slot member 200 with attachment handle 214 in open-ended slot 120, protrusion 158 extends into or through latch opening 212 (shown in FIGS. 6A-6C) to prohibit separation of clip member 100 and slot member 200.

In FIG. 8B, locking mechanism 150 is in the second position where handle portion 152 has been pivoted about shaft 156 to a clip member open position away from clip member body 110. As locking mechanism 150 moves to the second position, protrusion 158 rotates out of open-ended slot 120 and into lever slot 128, thereby permitting egress and ingress of attachment handle 214 to open-ended slot 120. Accordingly, clip member 100 can be attached to or removed from slot member 200. Similarly, when locking mechanism 150 is in the second position, clip member 100 can be installed on or removed from an article of clothing. After installing clip member 110 on an article of clothing, moving locking mechanism 150 towards or to the first position causes protrusion 158 to clamp the clothing between protrusion 158 and rear jaw 122.

Figure 9:
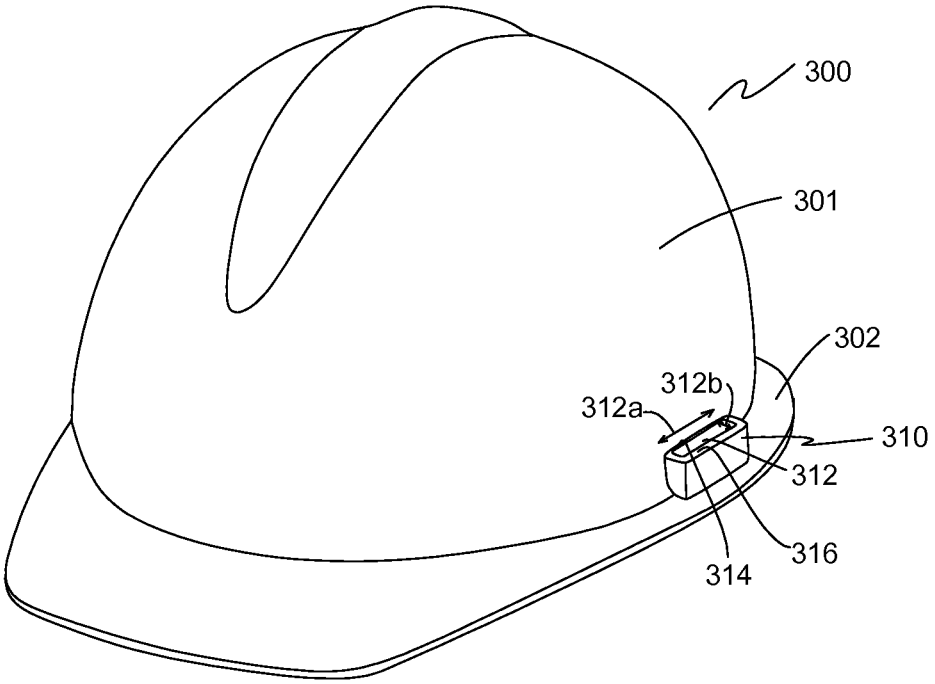
FIGURE 9 (prior art)
FIG. 9 is a perspective view of one embodiment of a hard hat of the prior art showing a universal accessory slot along the brim.

Turning now to FIG. 9, a front perspective illustration shows an example of a hard hat 300 as is known in the art. Hard hat includes a shell 301 with a brim 302, which are typically made of high-density polyethylene. Along the sides of the shell 301 and adjacent brim 302, hard hat 300 has a pair of oppositely positioned universal accessory slots 310 (only one is visible) where each has an accessory slot opening 312 between a first slot wall 314 and a second slot wall 316 that opposes and is spaced apart from first slot wall 314. Typically, accessory slot opening 312 has a length 312*a* of about three centimeters and a width 312*b* of about three millimeters.

Figure 10:
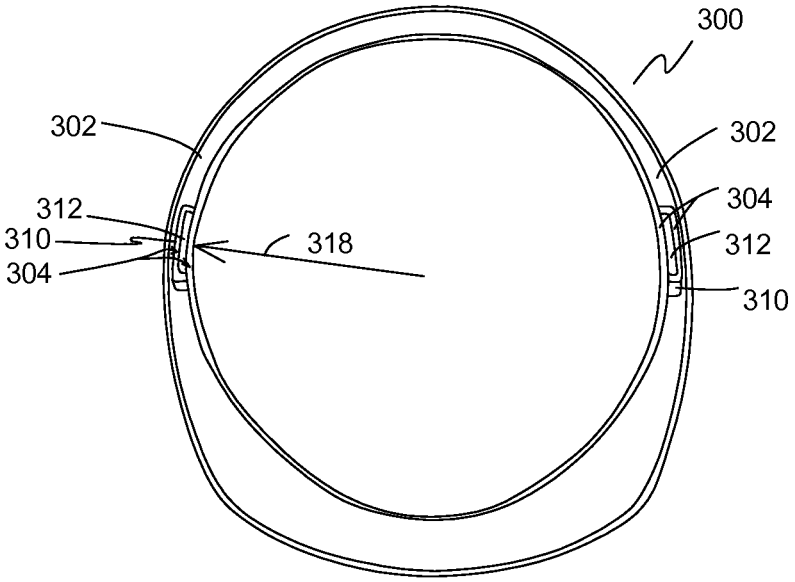
FIGURE 10 (prior art)
FIG. 10 is a bottom plan view of the hard hat of FIG. 7 showing a slot rim adjacent the accessory slot opening of each universal accessory slot.

Turning now to FIG. 10, a bottom plan view illustrates hard hat 300 of FIG. 7. Accessory slot openings 312 extend through brim 302. As discussed above, catch surface 236 of lip 234 (shown in FIGS. 3A & 3C) overlaps and/or engages slot rim 304 located adjacent accessory slot opening 312 when slot member body 230 of slot member 200 is inserted into universal accessory slot 310 to the extent that lip 234 extends beyond slot rim 304. Brim 302 has a radius of curvature 318, typically about ten centimeters.

Figure 11:
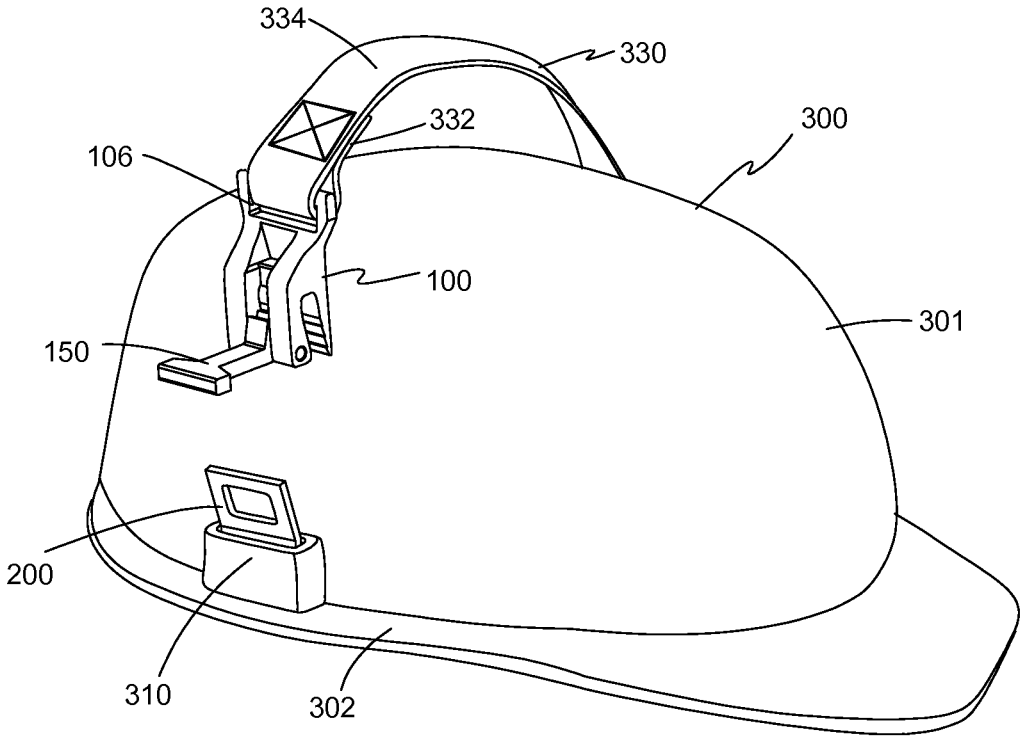
FIG. 11 is a perspective illustration of one embodiment of a tether clip system of the present invention showing the slot member installed in the universal accessory slot and the clip member connected to a hard hat tether are ready for attachment to the slot member.

Turning now to FIG. 11, a perspective illustration shows a portion of hard hat 300 with an embodiment of tether clip system 10. Slot member 200 is installed in universal accessory slot 310 and locked in place with lip 234 overlapping and/or engaging slot rim 304 (not visible). Clip member 100 has locking mechanism 150 in the first (open) position and is capable of attaching to slot member 200. A hard hat tether 330 has a first tether end 332 looped through strap opening 106 and secured to tether body 334. Tether body 334 extends over shell 301 with a second tether end 336 connected to hard hat 300, such as having second tether end 336 looped through a second universal accessory slot 310 (not visible) or otherwise secured to hard hat 300.

The various embodiments of slot member 200 provide installation and use options to the user. For example, in one embodiment, the user installs slot member 200 of FIGS. 3A-3D in one universal accessory slot 310. First tether end 332 is secured to clip member 100 and second tether end 336 is attached to hard hat 300 at another location (e.g., connected by a snap button to hard hat 300) where a second universal accessory slot 310 remains available for other hard hat attachments.

In another example, a pair of slot members 200 is used with each slot member 200 being installed in universal accessory slots 310 on opposite sides of hard hat 300. First tether end 332 is secured to clip member 100, which can be attached to slot member 200 on one side of hard hat 300. Second tether end 336 is looped through latch opening 212 of the opposite slot member 200. Thus, one slot member 200 secures second tether end 336 and another slot member 200 is used for storing clip member 100 when it is not in use.

In yet another example, slot member 200 of FIGS. 4A-4E is installed in one universal accessory slot 310 of hard hat 300. Second tether end 336 is looped through connector loop 260 to secure hard hat tether 330 to hard hat 300. First tether end 332 is secured to clip member 100, which may be attached to latch plate 210. Thus, a single slot member 200 is used both for securing hard hat tether 300 to hard hat 300 as well as stowing clip member 100 when it is not in use.

A method of storing a hard hat tether 330 attached to a hard hat 300 will now be explained. A user obtains a tether clip system 10 that includes a clip member 100 with clip member body 110 and locking mechanism 150, including a slot member 200 having a latch plate 210 and a slot member body, and also including a hard hat tether 330. In one embodiment, clip member 100 is an embodiment described above. In other embodiments, clip member 100 is a spring clip, suspender clip, connector, or other clip known in the art. In one embodiment, the user selects a tether clip system 10 with first tether end 332 secured through strap opening 106 of clip member 100.

Slot member 200 is installed into a universal accessory slot 310 of a hard hat 300 with slot member body 230 extending into accessory slot opening 312 to the extent that lip 234 extends past slot rim 304, thereby locking slot member 200 in universal accessory slot 310. In one embodiment, slot rim 304 is located on an underside of brim 304. In another embodiment, slot rim 304 is located above an upper side of brim 304 adjacent shell 301, where slot member 200 is inserted in an upward direction through universal accessory slot 310.

Second tether end 336 of hard hat tether 330 is secured to hard hat 300. In one embodiment, second tether end 336 is secured by looping through another universal accessory slot 310 on hard hat 300. Alternately, second tether end 336 is connected to the hard hat's suspension harness, through some other opening in hard hat 300, or to a connector (not shown) attached to hard hat 300.

When clip member 100 is not being used to secure hard hat tether 330 to the user's clothing, clip member 100 is attached to slot member 200 by inserting latch plate 210 into open-ended slot 120. Clip member is then secured to slot member 200 by moving locking mechanism 150 to the first (closed) position while maintaining latch plate 210 in open-ended slot 120.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

The invention claimed is:

1. A slot member for use with a hard hat having a universal accessory slot, the slot member comprising: a slot member body having a proximal body end portion and a distal body end portion, a front face, and a rear face, the slot member body comprising: a resilient tab protruding in a first direction away from the front face of the slot member body; and a lip extending from the proximal body end portion in a second direction transversely away from the rear face of the slot member body and defining a catch surface facing towards the distal body end portion, the second direction being substantially opposite of the first direction; wherein the slot member body is plate-like and sized to be received through the universal accessory slot of the hard hat with the resilient tab abutting a first slot wall and the lip overlapping a slot rim; and a latch plate adjoining and extending distally from the distal body end portion of the slot member body, the latch plate having a latch opening extending therethrough and defining an attachment handle along a distal end of the latch plate wherein the attachment handle is configured to be received by a clip member having a locking mechanism that closes through the latch opening; wherein the latch plate and the front face of the slot member body define an angle from 160° to 175° wherein when installed in the universal accessory slot of the hard hat with the front face facing away from a hard hat shell of the hard hat, the latch plate diverges from the hard hat shell as the slot member extends out from the universal accessory slot and away from the hat brim, thereby spacing the attachment handle from the hard hat shell for attachment to the latch plate by the clip member; and wherein the slot member further comprises the clip member defining a strap through-opening and having the locking mechanism adapted to secure the clip member to the latch plate.

2. The slot member of claim 1, wherein the resilient tab includes a tab body connected to the slot member body and extending transversely from the plate-like body to a distal tab portion, wherein the resilient tab defines a gap between the distal tab portion and the front face of the slot member body thereby permitting the resilient tab to flex towards the front face.

3. The slot member of claim 1, wherein the slot member body has a substantially U-shaped opening defining a tab body connected to the slot member body at a proximal tab end and extending to a distal tab end portion, wherein the tab body includes a tab protrusion connected to the distal tab end portion and extending in the first direction beyond the front face.

4. The slot member of claim 1, wherein when the slot member body is installed in the universal accessory slot, the resilient tab abuts the first slot wall, thereby biasing the slot member body towards a second slot wall and biasing the lip to overlap the slot rim along the universal accessory slot.

5. The slot member of claim 1, further comprising:

a connector loop extending transversely from a front slot member front surface and defining a connector loop opening.

6. The slot member of claim 5, wherein the connector loop is removably attachable to the slot member body or the latch plate.

7. The slot member of claim 1, wherein the locking mechanism comprises:

an open-ended slot sized to receive the attachment handle; and a clip lever pivotably attached to the clip body and operable between a first position and a second position, the clip lever having a protrusion extending from the lever portion, wherein the protrusion substantially closes the open-ended slot when the clip lever is in the first position and opens the open-ended slot when the clip lever is in the second position.

8. In combination, a slot member and a hard hat comprising: a hard hat with a hard hat shell, a hat brim, and having at least one universal accessory slot with an accessory slot opening between a first slot wall and a second slot wall opposing and spaced apart from the first slot wall, and a slot rim extending along the universal accessory slot transverse to the accessory slot opening; and a slot member comprising: a slot member body having a proximal body end portion and a distal body end portion, a front face, and a rear face, the slot member body comprising: a resilient tab protruding in a first direction away from the front face of the slot member body; and a lip extending from the proximal body end portion in a second direction transversely away from the rear face of the slot member body and defining a catch surface facing towards the distal body end portion, the second direction being substantially opposite of the first direction; wherein the slot member body is plate-like and sized to be received through the universal accessory slot of the hard hat with the resilient tab abutting the first slot wall and the catch surface overlapping the slot rim; and a latch plate adjoining and extending distally from the distal body end portion of the slot member body, the latch plate having a latch opening extending therethrough and defining an attachment handle along a distal end of the latch plate wherein the attachment handle is configured to receive a clip member having a locking mechanism that closes through the latch opening; and wherein the latch plate and the front face of the slot member body define an angle from 160° to 175°, wherein when installed in the universal accessory slot of the hard hat with the front face facing away from the hard hat shell, the latch plate diverges from the hard hat shell as the slot member extends out from the universal accessory slot and away from the hat brim, thereby spacing the attachment handle from the hard hat shell for attachment to the latch plate by the clip member; and further comprising the clip member defining a strap opening and having the locking mechanism adapted to secure the clip member to the latch plate.

9. The combination of claim 8, further comprising a U-shaped connector loop extending transversely from the latch plate and defining a connector loop opening.

10. The combination of claim 8, wherein the resilient tab includes a tab body connected to the slot member body and extending transversely from the plate-like body to a distal tab portion, wherein the resilient tab defines a gap between the distal tab portion and the front face of the slot member body thereby permitting the resilient tab to flex towards the front face.

11. The combination of claim 8, wherein the slot member body has a substantially U-shaped opening defining a tab body connected to the slot member body at a proximal tab end and extending to a distal tab end portion, wherein the tab body includes a tab protrusion connected to the distal tab end portion and extending in the first direction beyond the front face.

12. The combination of claim 8, wherein when the slot member body is installed in the universal accessory slot, the resilient tab abuts the first slot wall, thereby biasing the slot member body towards the second slot wall and biasing the lip to overlap the slot rim along the universal accessory slot.

13. The combination of claim 8, wherein the slot member body has an arcuate shape across a width of the slot member body.

14. The combination of claim 8, further comprising a hard hat tether having a first end portion adapted to be connected through the strap opening of the clip member and a second end portion adapted to be connected to the hard hat through a second one of the at least one universal accessory slots.

15. A method of storing a hard hat tether attached to a hart hat, the method comprising: providing a hard hat having at least one universal accessory slot with at least one universal accessory slot having an accessory slot opening between a first slot wall and a second slot wall opposing and spaced apart from the first slot wall, and a slot rim extending along the universal accessory slot transverse to the accessory slot opening; providing a slot member comprising: a slot member body having a proximal body end portion and a distal body end portion, a front face, and a rear face, the slot member body comprising: a resilient tab protruding in a first direction away from the front face of the slot member body; and a lip extending from the proximal body end portion in a second direction transversely away from the rear face of the slot member body, the second direction being substantially opposite of the first direction; wherein the slot member body is plate-like and sized to be received through the at least one universal accessory slot of the hard hat with the resilient tab abutting the first slot wall and the lip overlapping the slot rim; and a latch plate adjoining and extending distally from the distal body end portion of the slot member body, the latch plate having a latch opening extending therethrough and defining an attachment handle along a distal end of the latch plate, wherein the attachment handle is configured to be received by a clip member having a locking mechanism that closes through the latch opening, wherein the latch plate and the front face of the slot member body define an angle from 160° to 175°, and wherein when installed in the universal accessory slot of the hard hat with the front face facing away from the hard hat shell, the latch plate diverges from the hard hat shell as the slot member extends out from the universal accessory slot and away from the hat brim, thereby spacing the attachment handle from a hard hat shell of the hard hat for attachment to the latch plate by the clip member; providing a clip member defining a strap opening and having a mouth with a locking mechanism adapted to secure the clip member to the latch plate by receiving the attachment handle into the mouth and closing the locking mechanism through the latch opening; providing a hard hat tether having a first tether end and a second tether end; securing the first tether end of the hard hat tether to the clip member; securing the second tether end to the hard hat; installing the slot member into the at least one universal accessory slot by inserting the slot member body into the accessory slot opening with a tab protrusion disposed within the at least one universal accessory slot, wherein a catch surface overlaps the slot rim and with the latch plate diverging from the hard hat shell as the slot member extends out from the universal accessory slot; and attaching the clip member to the latch plate of the slot member by inserting the attachment handle into the mouth and closing the locking mechanism through the latch opening.

16. The method of claim 15, wherein the step of securing the second tether end to the hard hat includes providing an additional slot member comprising: a slot member body having a proximal body end portion and a distal body end portion, a front face, and a rear face, the slot member body comprising: a resilient tab protruding in a first direction away from the front face of the slot member body; and a lip extending from the proximal body end portion in a second direction transversely away from the rear face of the slot member body, the second direction being substantially opposite of the first direction; wherein the slot member body is plate-like and sized to be received through the at least one universal accessory slot of the hard hat with the resilient tab abutting the first slot wall and the lip overlapping the slot rim; and a latch plate adjoining and extending distally from the distal body end portion of the slot member body, the latch plate having a latch opening extending therethrough and defining an attachment handle along a distal end of the latch plate, wherein the attachment handle and latch opening are configured to engage a clip member that receives the attachment handle and closes through the latch opening, wherein the latch plate and the front face of the slot member body define an angle from 160° to 175°, and wherein when installed in the universal accessory slot of the hard hat with the front face facing away from the hard hat shell, the latch plate diverges from the hard hat shell as the slot member extends out from the universal accessory slot and away from the hat brim, thereby spacing the attachment handle from the hard hat shell; and installing the additional slot member into another of the at least one universal accessory slot by inserting the slot member body into the accessory slot opening with a tab protrusion disposed within the another of the at least one universal accessory slot wherein a catch surface overlaps the slot rim; and looping the second tether end through the latch opening of the additional slot member.

17. The method of claim 15, wherein the step of providing the slot member includes selecting the slot member having a connector loop extending transversely from the latch plate and defining a connector loop opening; and wherein the step of securing the second tether end to the hard hat includes looping the second tether end through the connector loop.

* * * * *